US005257040A

United States Patent [19]

Czernik et al.

[11] Patent Number: 5,257,040

[45] Date of Patent: Oct. 26, 1993

[54] SYSTEM FOR PRINTING ASYMMETRICALLY POSITIONED PAIRS OF ENVELOPES

[75] Inventors: Roman Czernik, Trumbull; Steven A. Supron, Norwalk, both of Conn.

[73] Assignee: Pitney Bowes Inc., Stamford, Conn.

[21] Appl. No.: 792,112

[22] Filed: Nov. 14, 1991

[51] Int. Cl.[5] ..... G01D 9/42; B65H 5/00

[52] U.S. Cl. ..... 346/108; 271/2; 346/134

[58] Field of Search ..... 346/108, 134; 271/2, 271/9, 241

[56] References Cited

U.S. PATENT DOCUMENTS

| | | | |
|---|---|---|---|
| 4,397,542 | 8/1983 | Brodesser | 355/311 X |
| 4,538,905 | 9/1985 | Griego et al. | 346/160 |
| 4,603,846 | 8/1986 | Miles | 271/2 |
| 4,625,641 | 12/1986 | Jagosz et al. | 271/2 X |
| 4,733,310 | 3/1988 | Kapp et al. | 358/300 |
| 4,853,869 | 8/1989 | Durst, Jr. et al. | 364/478 |
| 4,971,311 | 11/1990 | Tsukimoto | 271/241 X |
| 5,069,434 | 12/1991 | Sellers | 271/2 |
| 5,154,410 | 10/1992 | Baader et al. | 271/2 X |
| 5,192,141 | 3/1993 | Chung et al. | 271/242 X |

*Primary Examiner*—A. T. Grimley
*Assistant Examiner*—Nestor R. Ramirez
*Attorney, Agent, or Firm*—Robert H. Whisker; Melvin J. Scolnick

[57] ABSTRACT

An envelope printing systems including a laser printer or similar printer operating under control of a microcomputer to print pairs of envelopes. The envelopes are printed with a FIM mark in a manner consistent with the requirements of the U.S.P.S. The envelopes are fed, two at a time, from a cassette which includes an identification mark. The envelopes are positioned in the cassette offset to one side and the printer is responsive to the identification mark to shift the image field to the opposite side so that the FIM mark is positioned on the upper edges of the envelopes, as required by regulation.

11 Claims, 4 Drawing Sheets

SYSTEM FOR PRINTING ASYMMETRICALLY POSITIONED PAIRS OF ENVELOPES

BACKGROUND OF THE INVENTION

The subject inventions relates to a system for addressing envelopes. More particularly, it relates to a system including a laser printer or the like operating under control of a micro-computer or the like to print envelopes with addresses; the addresses including information in barcode form and a special mark in accordance with regulations of the U.S. Postal Service indicating that the mail piece is suitable for automated processing, which mark is referred to herein as a FIM mark.

It is known, as is taught in U.S. Pat. No. 4,397,542; to: Brodesser, to print envelopes using a laser printer or the like. In developing the system of the subject invention Applicants have realized that it is desirable to print envelopes in a "two-up" mode. That is, to print envelopes two at a time, short edge first. (In general the paper path of a laser printer is too narrow and the spacing between drive rollers is too great to allow normal envelopes to be feed long edge first.) Such "two-up" printing is known for use with multilith printers and duplicators, which are used to print sequences of envelopes with identical information. Such "two-up" feeding of envelopes is taught in U.S. Pat. Nos. 4,603,846 and 4,625,641; to: Miles and JAGOSZ ET AL, respectively. Applicants have recognized that it is highly desirable to provide a system wherein a substantially conventional laser printer is driven by a micro-computer to address sequences of envelopes. However, as will discussed more fully below, the printing geometry of such printers is such that pairs of standard number 10 size envelope are not easily printed in accordance with the U.S. Postal Service requirements for machinable mail. Particularly, it is difficult in such a system to position the FIM mark, which is a particular mark printed on a mail piece in accordance Postal Service regulations to indicate that that mail piece is machinable, in accordance with Postal Service regulations. These regulations require that the FIM mark be printed within approximately one millimeter of the upper edge of the envelope.

Co-pending, commonly assigned U.S. patent application Ser. No. 07/643,616; to: Silverberg relates to an invention developed during the course of the same project which lead to the development of the subject invention and describes a system for printing of envelopes with barcode information in accordance with regulations of the Postal Service. In the '616 application a sample envelope is printed and the error in position determined and this error is used to correct subsequent printing. The correction may be carried out either by shifting the envelopes as they are feed or by shifting the image to be printed within the print field.

Another co-pending, commonly assigned application is U.S. patent application No. 07/747,581; to: Silverberg, which relates to two-up printing of envelopes. This application discloses a system for determining the sequences in which envelopes are to be printed and is not concerned with the printing of either barcode or FIM marks.

Thus, it is an object of the subject invention to provide a system wherein a substantially conventional laser printer or the like may be used to simultaneously print pairs of envelopes with address information; the address information including FIM marks in accordance with Postal Service regulations.

BRIEF SUMMARY OF THE INVENTION

The above object is achieved and the disadvantages of the prior art overcome in accordance with the subject invention by means of a printing system for printing two envelopes simultaneously in one mode of operation and for printing another type of item in a second mode of operation, which includes a printer of the type which prints successive scan lines on a substrate (i.e. envelope or other type of printable item) as the substrate is transported through the printer, where the scan lines have predetermined length, and which printer has a capability to shift the scan lines transversely to the direction of motion of the substrate. (That is to say that the field in which an image is printed can be shifted relative to the substrate without shifting the image relative to the field.) The system also includes a cassette for selective engagement with the printer and for successive input of pairs of envelopes simultaneously. The cassette further include a pair of input mechanism for successively presenting the pairs of envelopes to the printer, where the input mechanisms are offset towards one side of the cassette by a first predetermined amount: and the cassette also includes a machine recognizable identification symbol for identifying the cassette. The printer further includes apparatus responsive to the identification symbol when the cassette is engaged with the printer for controlling the printer to operate in the above mentioned mode and shift the scan line a second predetermined amount towards the opposite side of the cassette. The amounts by which the input mechanisms are offset and the scan line is shifted are selected so that the end of the scan line nearest the opposite side of the cassette and the edge of the envelopes nearest the opposite side substantially coincide during printing.

Thus, since the print field, which is composed of successive scan lines, coincides with one outside edge of the envelope. Both envelopes may be printed with FIM which coincide with the upper edge of each envelope where the upper edges are defined to be the outside edge of the envelope nearest the opposite side and the inside edge of the second envelope. Thus, the above object is achieved. Other objects and advantages of the subject invention will be readily apparent to those skilled in the art from consideration of the detailed description set forth below and of the attached drawings.

DETAILED DESCRIPTION OF THE PREFERRED EMBODIMENTS OF THE SUBJECT INVENTION

Figure 1:
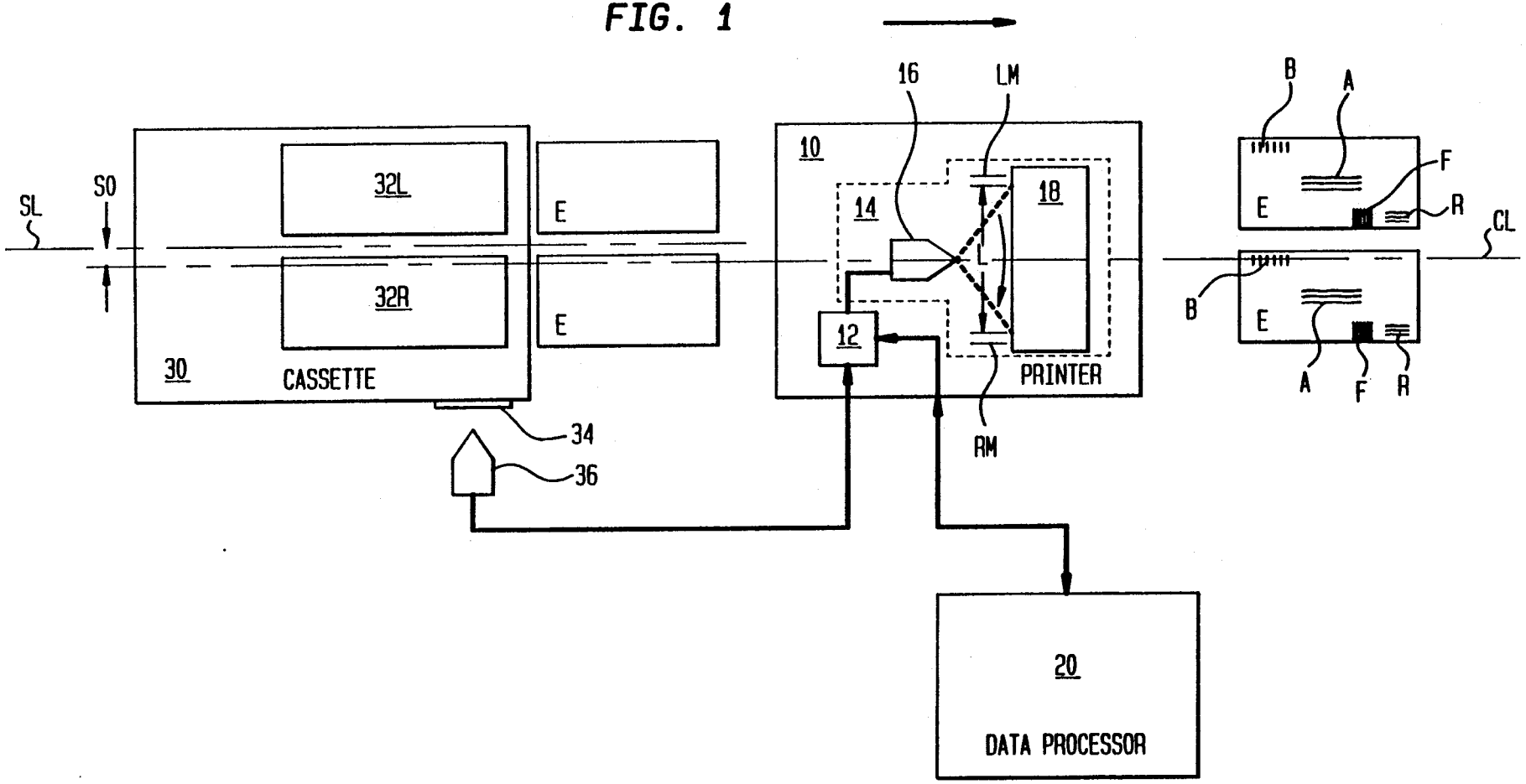
FIG. 1 shows a schematic block diagram of a system in accordance with the subject invention.

FIG. 1 shows a schematic block diagram of a system in accordance with the subject invention, which includes a printer 10. Printer 10 is preferable a substantially conventional laser printer with modifications as will be described further below, but may be any other suitable form of printer, such as a dot matrix printer, of the type which is used as an output printer for a microcomputer. A suitable printer would be a model W100 printer produced by the Mita Corporation of Japan and marketed by the assignee of the present application, modified as will be described below. Print engine 10 includes a controller 12, which is typically any suitable microprocessor, and a print engine 14. Engine 14 includes a laser scanner 16 which operates under the control of controller 12 to scan print drum 18 with a raster of lines having a length to create a representation of an image on a substrate, which is shown in FIG. 1 to be a pair of envelopes transported side-by-side through printer 10. The scan lines comprising the image raster may be positioned under control of controller 12 anywhere between a left margin LM and a right margin RM.

The operation of printers such as printer 10 is well understood by those skilled in the art and need not be discussed further here for an understanding of the subject invention.

Printer 10 operates under control of data processor 20, which may be any suitable computer and is typically a microcomputer, to print envelopes with address information in a conventional manner. Envelopes E, shown in FIG. 1 are printed by printer 10 with an image which includes address information A, a "Postnet" barcode representative of the destination zip code B, a return address R and FIM mark. The FIM mark is a special mark printed on an envelope in accordance with the regulations of the U.S. Postal Service to perform a course sort and to indicate that the envelope is suitable for handling by machine. In accordance with these regulations the FIM mark must be printed within approximately 1 millimeter of the upper edge of the envelope. As will be described below this requirement requires modification of printer 10 in accordance with the subject invention.

Pairs of envelopes E are input to printer 10 from a cassette 30. Cassettes are generally known for use with laser printers, copiers and other forms of equipment which print on various substrates. Cassette 30 includes a pair of mechanism 32L and 32R for holding stacks of envelopes and feeding successive pairs of envelopes into printer 10. Mechanisms 32L and 32R are positioned symmetrically around a line SL so that envelopes E are input to printer 10, similarly positioned symmetrically around line SL. Line SL is offset from the system center line CL by an amount SO.

Cassette 30 also includes an identification mark 34 which is recognizable by sensor 36 to indicate that cassette 30 is intended for input of pairs of envelopes. Preferably identification mark 34 comprises small magnets and sensor 36 comprises Hall effect switches, though any other suitable means of identifying cassettes, may be used. Printer 10 is modified by programming controller 12 to response to detection of identification mark 34 by sensor 36 to control laser scanner 16 to shift the raster field to the right, as will be described further below.

While identification of cassettes for various types of input materials for use with printers and copiers and the like is known, and techniques for such recognition need not be discussed further here for an understanding of the subject invention, it has not heretofore been known to shift a raster field in response to detection of a particular type of cassette.

Figure 2:
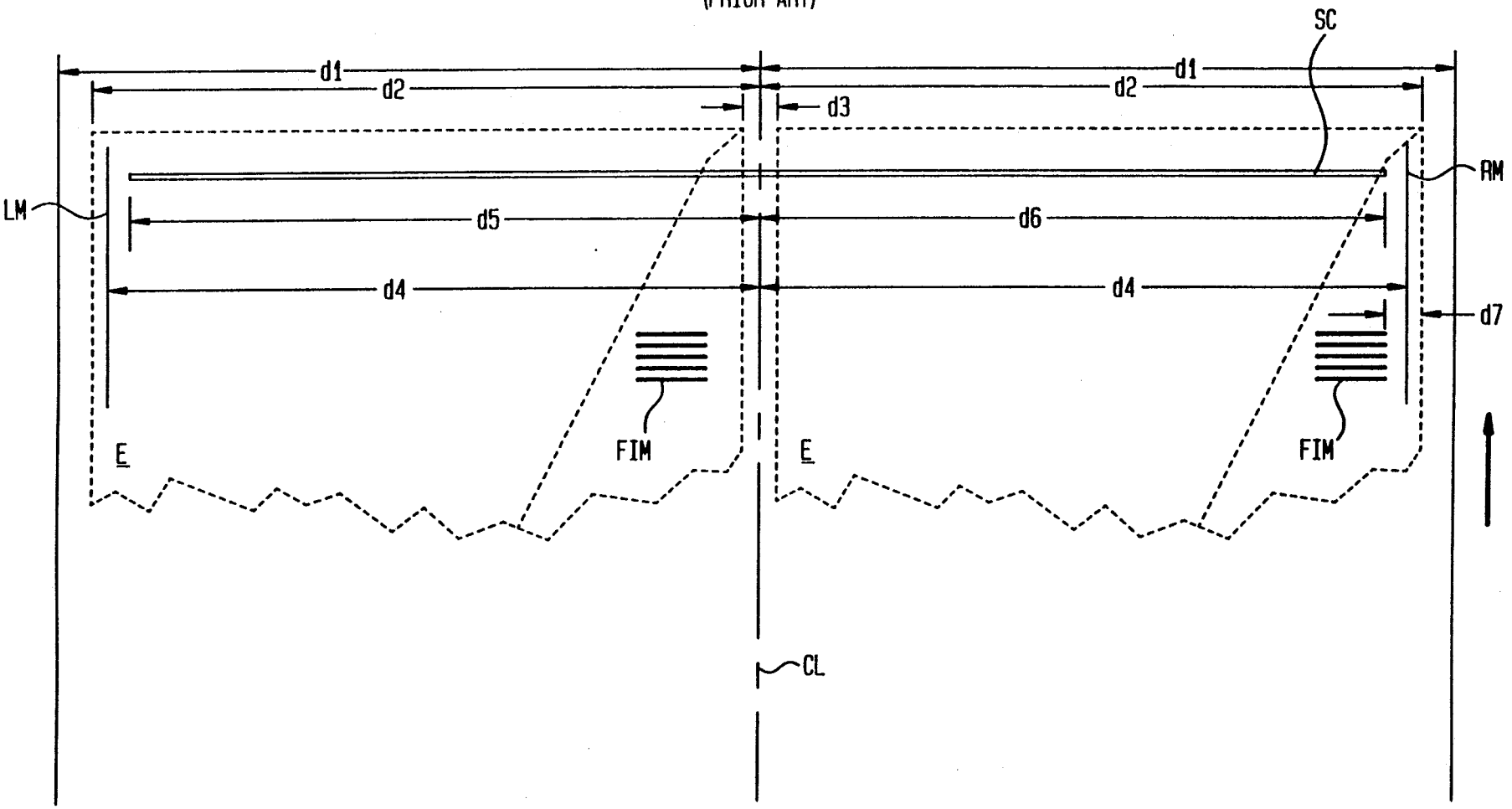
FIG. 2 (PRIOR ART)
FIG. 2 is a schematic representation of the print geometry where pairs of envelopes are transported symmetrically with the center line of a printer.

FIG. 2 shows a print geometry for a pair of envelopes feed through printer 10 in the most likely manner, positioned symmetrically around the system center line CL.

Values for dimensions for a typical laser printer intended to print 8½ size paper (i.e., the above mentioned W100) are given in Table I.

Printer 10 provides for a maximum width d1 measured from center line CL. A pair of standard number 10 envelopes positioned symmetrically about center line CL will have their outer edges at a distance d2 when a clearance d3 is provided between the envelopes. Left margin LM and right margin RM are each a distance d4 from center line CL. A scan line SC is printed on the envelopes E at the point where drum 18 is in contact with envelopes E as they move through printer 10 in the direction shown. Typically, the left and right ends of line SC are at a distance d5 and d6 from center line CL, where distance d6 is normally made slightly greater than distance d5. Thus it can be seen in FIG. 2 that the FIM mark can be printed no closer to the outer edge of right envelopes E than a distance d7, which will normally be greater than the tolerances allowed by the Postal Service regulations.

Figure 3:
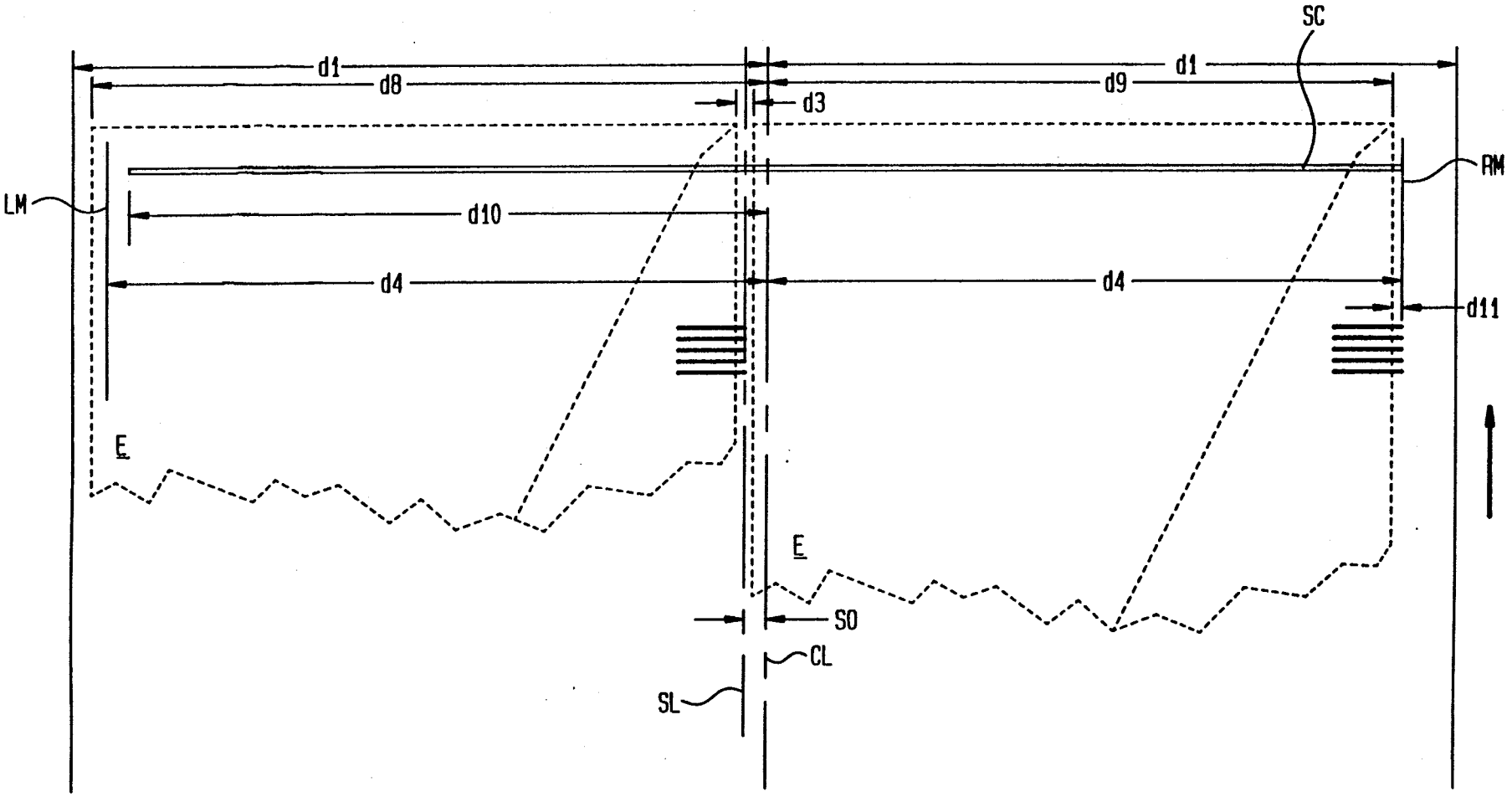
FIG. 3 is a schematic representation of the print geometry of the subject invention.

Turning to FIG. 3 the print geometry in accordance with the subject invention is shown. In FIG. 3 similarly dimensioned distances have the same values as in FIG. 2. In FIG. 3 envelopes E are positioned symmetrically around line SL which is offset by an amount SO of approximately 3 millimeters. Because of offset SO a distance to the outer edge of right most envelopes E is now d9, less then the distance to right margin RM d4. At the same time, in response to detection of identification mark 34, the controller 12 shifts scan line SC so that its right end coincides with right margin RM at a distance d4 from center line CL. The outer edge of left most envelopes E is at a distance d8 and the left end of scan line SC is at a distance d10 from center line CL.

TABLE I

| Dimension | Value (Millimeters) |
|---|---|
| d1 | 113 |
| d2 | 107 |
| d3 | 4.5 |
| d4 | 105 |
| d5 | 100.3 |
| d6 | 102.9 |
| d7 | 4.1 |
| d8 | 110 |
| d9 | 104 |
| d10 | 98.2 |
| d11 | 1.0 |

As can been seen in FIG. 3 the FIM mark now overlaps the outer edge of right most envelopes E by a distance d11, thus assuring that the FIM mark is within the tolerances of the Postal Service regulation even for slightly oversized envelopes. As can also been seen in FIG. 3 the amount of offset SO is limited by the minimum clearance needed at the outer edge of left most envelope E, that is the difference between d1 and d8. Typically, this minimum clearance will be approximately 3 millimeters for nominal number 10 envelopes.

Figure 4:
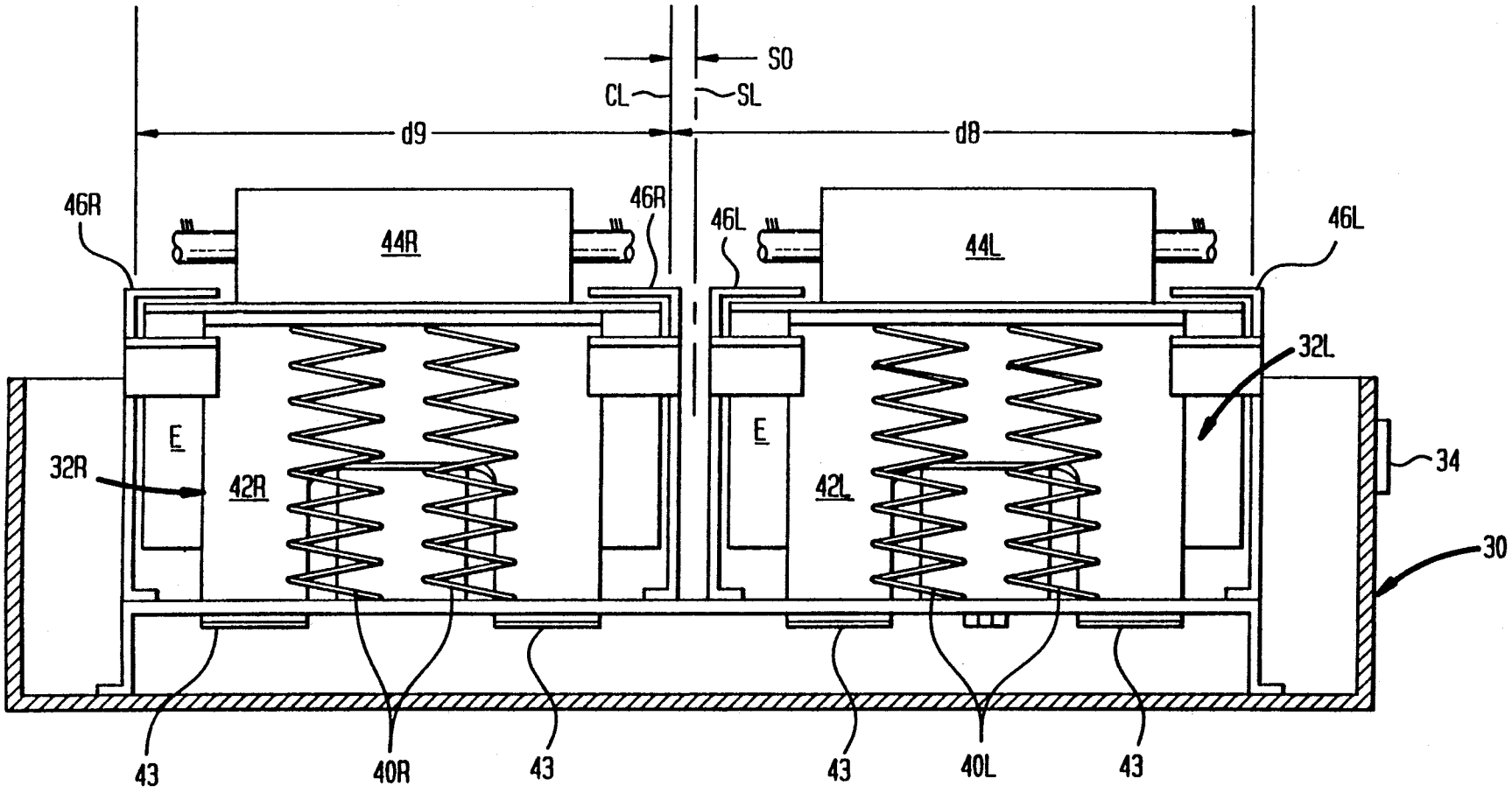
FIG. 4 is a cross sectional front view of a cassette for feeding pairs of envelopes simultaneously.

Turning to FIG. 4, a front cross sectional view of cassette 30 is shown. Cassette 30, as discussed above includes mechanisms 32 L and 32 R for feeding stacks of envelopes E to printer 10. Preferably mechanisms 32 L and 32 R are conventional elevators substantially similar to those described in commonly assigned, co-pending U.S. application Ser. No. 07/492,035, Filed Mar. 12, 1990. Mechanisms 32 L and 32 R are positioned symmetrically around line SL which is offset by an amount so from centerline CL. Springs 40L and 40R apply a force against platforms 42L and 42R causing platforms 42L and 42R to pivot about pivots 43 at the rear of the platforms and bringing rollers 44L and 44R into contact with envelopes E which are the top most envelopes of a stack supported by platforms 44L and 42R. Rollers 44L and 44R form part of printer 10 and operate under control of controller 12 to drive the top envelope E forward into printer 10. Conventional separator mechanisms (not shown) are provided in printer 10 to avoid double feeding of envelopes. In general the operation of such cassettes is known and need not be discussed further here for an understanding of the subject invention.

Mechanisms 32L and 32R also include guides 46L and 46R for establishing the lateral position of envelopes E as they are transported through printer 10. As can been seen in FIG. 4 guides 46L and 46R are positioned in accordance with the subject invention to establish dimensions d8 and d9.

The above embodiments have been described by way of illustration only and numerous other embodiments of the subject invention will be apparent to those skilled in the art from consideration of the above description and the attach drawings. Accordingly, limitation on the subject invention are to be found only in the claims set forth below.

What is claimed is:

1. A printing system for printing two envelopes simultaneously in one mode of operation and for printing another type of item in a second mode of operation, comprising:

a) a printer of the type which prints successive scan lines on a substrate as said substrate is transported through said printer, said scan lines having a predetermined length, and has a capability to shift said scan lines transversely to the direction of motion of said substrate;

b) a cassette for selective engagement with said printer for successive input of pairs of envelopes simultaneously, said cassettes further comprising:

b1) a pair of input means for successively presenting said pairs of envelopes for input to said printer, said input means being offset towards one side of said cassette by a first predetermined amount; and b2) identification means for identifying said cassette; wherein c) said printer further including means responsive to said identification means when said cassette is engaged for controlling said printer to operate in said one mode and shift said scan line a second predetermined amount towards the opposite side of said cassette; and wherein, d) said first and second predetermined amounts are selected so that the end of said scan line nearest said opposite side and the edge of said envelopes nearest said opposite side substantially coincide during printing.

2. A printing system as described in claim 1 wherein said printer prints said envelopes with addresses, address information in barcode form and a FIM mark substantially aligned with the flap edges of said envelopes.

3. A printing system as described in claim 2 wherein said scan line extends approximately 1 millimeter beyond the edge of said envelopes nearest said opposite wall, whereby said FIM mark will be correctly positioned on oversized envelopes.

4. A printing system as described in claim 3 wherein said printer prints $8\frac{1}{2} \times 11$ cut sheets in said second mode and provides a paper path with approximately 2 millimeters of clearance on each side of said sheet, and said envelopes are standard number 10 envelopes with a nominal width of $4\frac{1}{8}$ inches.

5. A printing system as described in claim 2 wherein said printer prints $8\frac{1}{2} \times 11$ cut sheets in said second mode and provides a paper path with approximately 2 millimeters of clearance on each side of said sheet, and said envelopes are standard number 10 envelopes with a nominal width of $4\frac{1}{8}$ inches.

6. A printing system as described in claim 1 wherein said printer prints $8\frac{1}{2}$ by 11 cut sheets in said second mode and provides a paper path with approximately 2 millimeters of clearance on each side of said sheet, and said envelopes are standard number 10 envelopes with a nominal width of $4\frac{1}{8}$ inches.

7. A method for printing envelopes simultaneously, comprising the steps of:

a) positioning two stacks of envelopes in a cassette with said stacks being offset by a first predetermined amount towards one side of said cassette;

b) engaging said cassette with a printer;

c) responding to said engaging of said cassette to shift scan lines produced by said printer toward the opposite side of said cassette by a second predetermined amount; where d) said first and second amounts are selected so that the end of said scan line nearest said opposite side and the edge of said envelopes nearest said opposite side substantially coincide during printing.

8. A method as describe in claim 7 comprising the further step of printing said envelopes with addresses, address information in barcode form and a FIM mark substantially aligned with the flap edges of said envelopes.

9. A method as described in claim 8 wherein said printer has a paper path approximately 226 millimeters wide and said envelopes have a nominal width of $4\frac{1}{8}$ inches.

10. A method as described in claim 7 wherein said scan lines extend approximately 1 millimeter beyond the edge of said envelopes nearest said opposite side, whereby said FIM mark will be properly positioned on over sized envelopes.

11. A method as described in claim 7 wherein said printer has a paper path approximately 226 millimeters wide and said envelopes have a nominal width of $4\frac{1}{8}$ inches.

* * * * *